United States Patent [19]

Stokes

[11] Patent Number: 4,648,139

[45] Date of Patent: Mar. 10, 1987

[54] MOUNTING RING ASSEMBLY FOR A TOILET BOWL

[76] Inventor: Darryll Stokes, 11576 Bridle Path Ln., Lakeside, Calif. 92040

[21] Appl. No.: 754,250

[22] Filed: Jul. 12, 1985

[51] Int. Cl.[4] ..... E03D 11/16

[52] U.S. Cl. ..... 4/252 R; 285/56

[58] Field of Search ..... 4/252 R; 285/56, 58

[56] References Cited

U.S. PATENT DOCUMENTS

| | | | |
|---|---|---|---|
| 3,012,252 | 12/1961 | Gaddy | 4/252 R |
| 3,419,288 | 12/1968 | Logsdon | 4/252 R |
| 3,674,288 | 7/1972 | Babb | 285/58 |
| 3,846,851 | 12/1974 | Pepper | 4/252 R |
| 4,052,759 | 10/1977 | Hill | 24/252 R |
| 4,185,334 | 1/1980 | Izzi | 285/58 |
| 4,212,486 | 7/1980 | Logsdon | 4/252 R |
| 4,306,738 | 12/1981 | Lindquist | 285/56 |

*Primary Examiner*—Stephen Marcus

*Assistant Examiner*—Leo J. Peters

*Attorney, Agent, or Firm*—Charles C. Logan, II

[57] ABSTRACT

A mounting ring assembly for a toilet bowl having a vertically oriented tubular member having a predetermined height. An annular flange extends radially outwardly from the top end of the tubular member. A base plate is located a predetermined height above the bottom end of the tubular member and it extends radially outwardly from the outer surface of the tubular member. A plurality of gussets connect the annular flange and the base plate. A plurality of open end slot assemblies are formed in the top surface of the annular flange and each of these have a bolt head slot and a bolt shank slot. A framework of a bottom wall, a pair of laterally spaced side walls and an end wall are formed around the open end of the open end slots. The open end slots receive bolts that are used to attach the base of a toilet bowl to the mounting ring assembly.

6 Claims, 3 Drawing Figures

MOUNTING RING ASSEMBLY FOR A TOILET BOWL

BACKGROUND OF THE INVENTION

The invention relates to a mounting ring assembly and more specifically to one used for securing the base of a toilet bowl to the second story floor of an apartment.

In the past the procedure for forming the second story floor of an apartment consists of a sheet of plywood framing being initially nailed in place. The carpenters then make a rough cut to form an opening where the drain pipe will come up through the plywood for the toilet bowl to be mounted thereon. Prior art ring assemblies had apertures in their top flange through which nails or screws could be inserted for holding the mounting ring assembly in place by securing these fasteners to the plywood framework of the second floor.

Due to the fact that the holes cut by the carpenters generally do not leave any of the plywood directly below the apertures in the flange, it was necessary to direct the screws in an outwardly angled position with the hope that they might draw into the plywood below.

A secondary problem resulting from the prior art ring assemblies and the form of butchery that the carpenters performed in cutting the holes for the drain pipe has to do with the fact that the second floor requires a layer of concrete to be poured upon the top surface of the plywood. Since the holes created by the carpenters did not mate tightly with the bottom surface of the mounting ring assemblies, the concrete would have a tendency to drop through the cracks resulting from the loose fit between the plywood and the bottom of the mounting ring assembly. This required the construction crew to have to plug up the cracks between the plywood and the bottom of the mounting ring assembly prior to the pouring of the second story floor.

An additional problem in the past has been controlling the degree of levelness of the surface of the concrete floor surrounding the mounting ring assembly. Often the resulting contour has produced a mound effect due to the impreciseness of the top surface of the mounting ring assembly being positioned too high above the plywood framing. A general code requirement calls for 1.5 inches of concrete to be layed on top of the plywood framing of the second floor.

It is an object of the invention to provide a novel mounting ring assembly that has structure for securing the mounting ring assembly to the second floor plywood framework no matter how much the carpenter has butchered the hole through which the drain pipe will extend and to which the mounting ring assembly is attached.

It is also an object of the invention to provide a novel mounting ring assembly for a toilet bowl that will eliminate the problem of concrete leakage between the mounting ring assembly and the aperture which has been cut in the second floor plywood framing.

It is another object of the invention to provide a novel mounting ring assembly for a toilet bowl that will precisely control the height of the top surface of the mounting ring assembly above the plywood framing of the second floor thereby eliminating crowns formed in the concrete when the concrete is layed.

It is additional object of the invention to provide a novel mounting ring assembly for a toilet bowl that can be economically manufactured and marketed.

It is a further object of the invention to provide a novel mounting ring assembly for a toilet bowl that has wax sealed into the bolt receiving apertures in the top surface of the mounting ring so that they are not filled with concrete during the operation of pouring the second floor.

SUMMARY OF THE INVENTION

Applicant's novel mounting ring assembly for a toilet bowl has been designed to eliminate several problems existing in the construction field. Primarily it has been designed to be used for the second floor or succeeding floors for apartments.

The mounting ring assembly has a vertically oriented tubular member having a predetermined height. It has an annular flange extending radially outwardly from the top end of the tubular member. It also has a base plate extending radially outwardly from the outer surface of the tubular member at a predetermined height above the bottom end of the tubular member. The distance between the top surface of the annular flange and the bottom surface of the base plate is 1.5 inches. By merely dropping the tubular member into the aperture cut by the carpenter in the plywood framework for the second floor of an apartment, the top surface of the ring assembly will always be 1.5 inches above the top surface of the plywood. Since it is generally a code requirement that the thickness of the concrete floor be 1.5 inches, it is merely necessary to pour the required concrete and level it to the height of the top surface of the annular flange.

The base plate that extends radially from the outer surface of the tubular member insures that no matter how poorly the carpenter cuts the aperture in the plywood framing for the mounting ring assembly, there will be a portion of the base plate in contact with the plywood framing thus enabling a plurality of nails to firmly secure the mounting ring assembly in position. This also eliminates the problem of concrete passing between the mounting ring assembly and the aperture cut in the plywood framework during the operation of pouring the second floor.

Since the bolt apertures in the top surface of the annular flange have been filled with wax, they do not become clogged or filled with concrete during the operation of pouring concrete second floor. When it comes time for installing the base of the toilet bowl on the top of the mounting ring assembly it is merely necessary to scrape the wax material out of these slots and the bolts can be easily inserted into their proper locations.

DESCRIPTION OF THE PREFERRED EMBODIMENT

Figure 1:
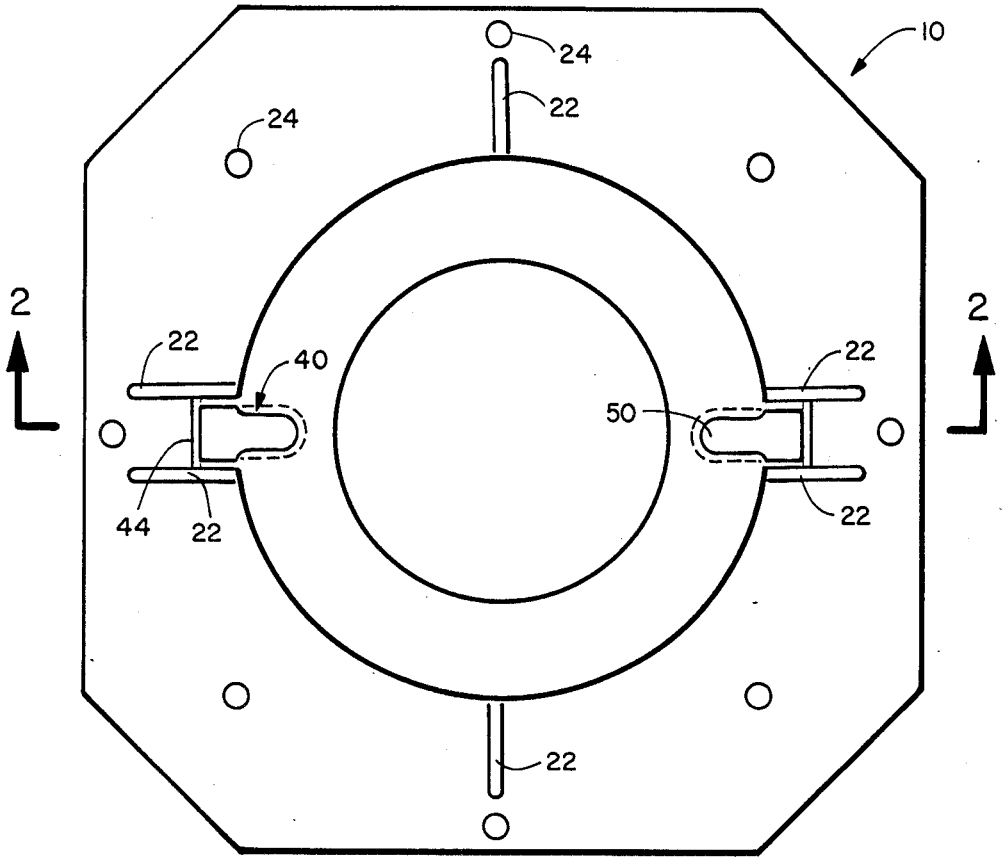
FIG. 1 is a top plan view of applicant's novel mounting ring assembly.
Figure 2:
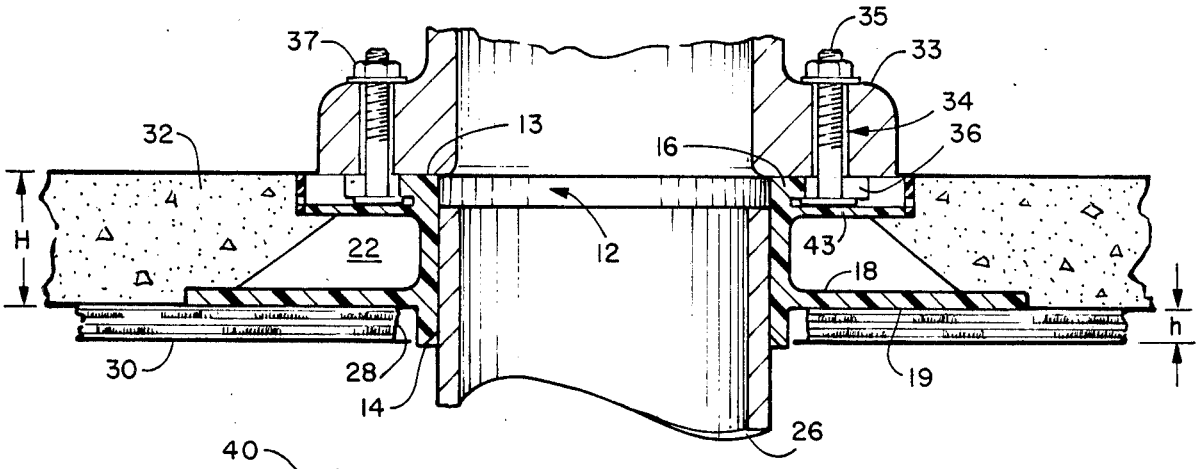
FIG. 2 is a side elevation view illustrating various portions in cross section to show how the mounting ring assembly appears after installation.
Figure 3:
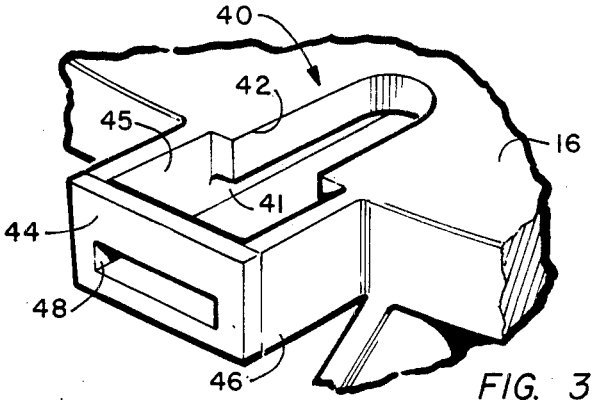
FIG. 3 is an enlarged partial view of the end slot assembly.

Applicant's novel mounting ring assembly will now be described by referring to FIGS. 1 and 2 of the drawings. The mounting ring asssembly is generally designated numeral 10.

Mounting ring assembly 10 has a tubular member 12 having a predetermined height which is generally 2 inches. It has a top end 13 and a bottom end 14. An annular flange 16 extends radially outwardly from the top end of tubular member 12. A base plate 18 also extends radially outwardly from the outer surface of tubular member 12 and it is located a predetermined height above the bottom end of the tubular member. The bottom surface 19 of base plate 18 is 1.5 inches from the top surface of annular flange 16 and is designated the letter H. The distance between the bottom surfaced 19 and the bottom end 14 of tubular member 12 is designated the letter h. A plurality of gussets 22 connect annular flange 16 and base plate 18. A plurality of fastener or nail apertures 24 are formed around the perimeter of base plate 18.

The mounting ring assembly is generally formed as an integral member from a plastic material. As seen in FIG. 1 it telescopically fits with drain pipe 26. Mounting ring assembly 10 also seats in an aperture 28 that has been cut in the plywood framing 30. The concrete floor 32 that has been poured has its top surface level with the top surface of annular flange 16. The base 33 of a toilet bowl is secured to the top surface 13 of annular flange 16 by a plurality of bolts 34 each having a shank portion 35 and a head portion 36. A nut 37 is used to tighten the base of the toilet bowl in position.

The top surface of annular flange 16 has a plurality of open end slot assemblies 40 formed therein. They have a bolt head slot 41 and a bolt shank slot 42. Surrounding these slots is a framework formed by bottom wall 43, end wall 44, and side walls 45 and 46. A slot 48 is formed in end wall 44 for molding purposes. These open end slot assemblies are filled with a wax plug 50 which is not removed until the base of the toilet bowl is to be assembled onto the top surface of the mounting ring assembly.

What is claimed is:

1. A mounting ring assembly for a toilet bowl comprising:

a vertically oriented tubular member having a predetermined height, said tubular member having a top end and a bottom end;

an annular flange extending radially outwardly from the top end of said tubular member;

a base plate extending radially outwardly from the outer surface of said tubular member, said base plate being located a predetermined height above the bottom end of said tubular member, a plurality of nail apertures in said base plate;

said tubular member, said annular flange, and said base plate being molded as an one-piece member of resinous plastic material; and means for attaching a plurality of bolts to said annular flange that are used to fasten the base of a toilet bowl to said mounting ring assembly comprising a plurality of radially extending open end slot assemblies in the top surface of said annular flange, each of said open slot (as-) assemblies having a bolt head slot and a bolt shank slot, a framework around the open end of said slot having a bottom wall, a pair of laterally spaced side walls, and an end wall, said bottom wall also forming the bottom surface of said bolt head slot, the height of the side walls and end wall of said framework being substantially the same as the thickness of said annular flange.

2. A mounting ring assembly as recited in claim 1 wherein said open end slot assemblies and its framework are filled with wax.

3. A mounting ring assembly as recited in claim 1 further comprising a plurality of gussets that connect said annular flange and said base plate.

4. A mounting ring assembly as recited in claim 1 wherein said base plate has a substantially planar bottom surface.

5. A mounting ring assembly as recited in claim 1 wherein the width of said mounting ring assembly is at least twice the dimension of its height.

6. A mounting ring assembly as recited in claim 1 wherein said base plate is at least 20 percent wider than said annular flange.

* * * * *